United States Patent [19]

LoStracco et al.

[11] Patent Number: 5,067,665

[45] Date of Patent: Nov. 26, 1991

[54] BASE LAYER FOR AN OPTICAL FIBER WOUND PACK

[75] Inventors: Gregory LoStracco; George W. LeCompte, both of Tucson, Ariz.

[73] Assignee: Hughes Aircraft Company, Los Angeles, Calif.

[21] Appl. No.: 611,811

[22] Filed: Nov. 13, 1990

[51] Int. Cl.[5] ..... B65H 75/18; B65H 75/10

[52] U.S. Cl. ..... 242/118.32; 242/117; 242/118.4; 242/118.7; 242/159; 242/176

[58] Field of Search ..... 242/118.32, 118.3, 118.31, 242/117, 118.4, 118.7, 118.8, 159, 176

[56] References Cited

U.S. PATENT DOCUMENTS

| | | | |
|---|---|---|---|
| 1,570,534 | 1/1926 | Sweeney et al. | 242/118.3 |
| 2,204,938 | 6/1940 | LeBus | 242/117 |
| 2,633,629 | 4/1953 | Crookston | 242/117 X |
| 2,954,702 | 10/1960 | Petersen | 242/117 X |
| 4,034,932 | 7/1977 | Ferch | 242/117 |

*Primary Examiner*—Stanley N. Gilreath

*Attorney, Agent, or Firm*—C. D. Brown; R. M. Heald; W. K. Denson-Low

[57] ABSTRACT

A winding form baselayer (20) has a flexible insulative substrate (22) on which a plurality of parallel spaced apart filament cable guides (24) are located. Optionally, the guides (24) can be formed by depositing a metal layer and etching out spaces (W) between the guides or plating the individual guides. A wound pack (28) is produced by winding a first filament layer (26) into the spaces (W) with subsequent layers wound over the first layer in conventional manner. In an alternate version, the filament cable guides (52) are etched into the top side of a metal sheet and the opposite side is etched into a diagonally arranged set of struts (56) which provide lateral resiliency for the entire baselayer (46).

14 Claims, 3 Drawing Sheets

BASE LAYER FOR AN OPTICAL FIBER WOUND PACK

BACKGROUND OF THE INVENTION

1. Field of the Invention

The present invention relates generally to the winding of filament cables, and, more particularly, to a winding baselayer and method of making the baselayer.

2. Description of the Related Art

It is known to provide a wound coil of filament cable such as an optical fiber, for example, aboard a missile which, on missile launch, is unwound to establish a data link between apparatus at the launch site and apparatus aboard the missile. In winding a pack for use as a data link dispenser, in testing the filament, or for any other reason, it has been found advantageous to provide a baselayer with grooves, or otherwise configured surface, for receiving the first filament winding layer in an orderly, evenly spaced arrangement without overlapping turns.

One known baselayer for this purpose is formed by winding onto the bobbin a preliminary layer of wire having a diameter substantially equal to that of the filament. The filament first winding layer is then wound into the spaces between the lower adjacent wire loops and subsequent windings are added in conventional manner. Such a baselayer is relatively costly and difficult to make.

Another known baselayer is constructed by first forming an epoxy film or layer on a winding bobbin, then winding a single wire layer over the epoxy which produces grooves in the epoxy outer surface as a result of the winding pressure. When the wire is removed, a pattern of grooves remains in the epoxy outer surface for use as a filament winding baselayer.

Illustrative of one form of known wire baselayer is that disclosed in U.S. Pat. application Ser. No. 263,804, HIGH DENSITY FILAMENT WINDING AND METHOD FOR PRODUCING IMPROVED CROSSOVERS AND INSIDE PAYOUT, by George W. LeCompte, assigned to the same assignee as the present application.

SUMMARY OF THE PRESENT INVENTION

Although the present invention can be advantageously employed in fabricating all kinds of wound filament packs, for ease of presentation it will be described herein primarily in connection with the production of an externally wound cylindrical pack on a cylindrical bobbin of appropriate diameter which, optionally, can have flanges on both ends to define the pack length. Alternatively, the winding bobbin can have a tapered construction on which a correspondingly tapered wound pack is formed.

A flexible reinforced epoxy substrate of the proper dimensions to enable being wrapped entirely around the mandrel with the substrate facing ends fitting together closely is provided. A material layer is laid down on a substrate major surface (which is to be the outer surface in use) of a predetermined thickness, T, equal to 0.2 to 0.4 times D for what might be termed a "normal" precision wound pack. The material layer is then etched in accordance with one method of the invention to form a plurality of separate "conductors" or cable guides generally parallel to one another except at so-called pitch advancement regions to be described. These cable guides may be produced by either etching a sheet of metal bonded to a flexible substrate as already mentioned or, optionally according to another method of the invention, by plating onto the substrate to form the individual cable guides. When seen in cross-section, the conductors form a set of upwardly extending equally spaced apart ridges defining cable guides as will be more particularly described.

The cable guides each extend parallel to the substrate longitudinal axis which, in turn, is substantially perpendicular to the bobbin winding axis on assembly. Accordingly, a filamentary cable wound into the spaces between individual cable guides results in a substantially square or rectangular cross-section winding which is desirable for obtaining a compact high density pack. A rectangular cross-section filamentary cable pack is also advantageous in that it is easier to adjust winding support flanges when used since the cable end windings are closely parallel to the flange faces. In the event end flanges are not used, it is customary when winding one cable layer over a previous one to have a stepback region so as to prevent the pack edges from deteriorating.

Specifically as to use, the finished substrate with raised material guides thereon is then wrapped onto a winding bobbin and secured thereto by an adhesive, for example, with outer edge guides being arranged precisely parallel to the flange faces except in the crossover regions. The cable is then wound into the spaces between the guides which, because of the predetermined spacing provided, locates the first fiber layer, and each successive layer, in either a close wound or deep-nested arrangement depending upon the spacing.

In an alternate embodiment of the invention, the winding baselayer has on its lower surface (i.e., the surface facing the bobbin on assembly) a herring bone pattern which effectively forms diagonal leaf springs. The upper surface on which the cables are to be wound includes, as in the first embodiment, a plurality of parallel cable guides spaced apart the required distance in order to permit either nested or normal winding of a cable pack. By this baselayer construction, it is contemplated that a substantial reduction can be obtained in the complexity and cost of a bobbin with flanges, in that where flanges formerly were required to be precisely adjustable to establish exact registration with a baselayer, this necessity is obviated by the present invention which has a built in self adjustment ability. Also, it appears likely that an increase in allowable tolerances may be obtained on both the baselayer and the bobbin as a result of the spring action of the herring bone layer.

It is sometimes desirable to add an adhesive to the pack, preferably during winding, in order to improve pack stability. It is also advisable in this case to have means enabling the adhesive to pass off from the pack rather than to have a relatively large and unnecessary amount of adhesive remain in the pack. The alternative embodiment of the invention is especially advantageous in this regard since the spaces in the herring bone layer permit adhesive flow-through impregnation of the pack.

DESCRIPTION OF THE PREFERRED EMBODIMENTS

Figure 1:
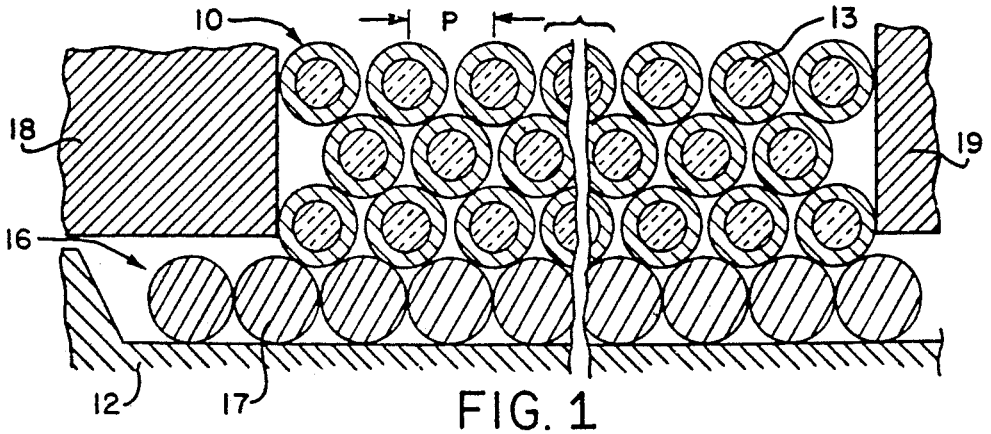
FIG. 1 Prior Art
FIG. 1 is a sectional elevational view of a prior art cable winding on a wire baselayer.

FIG. 1 of the drawings shows a sectional view of a filament cable pack 10 which has been wound onto a cylindrical bobbin or mandrel 12 in accordance with a prior art technique to obtain what might be termed a normal precision winding. More particularly, the cable pack of a filament 13 is wound onto a baselayer consisting of a single layer 16 formed by a wire 17 having a diameter approximately equal to that of the filament 13. The first layer of the cable pack is laid down into the spaces between each of the wire loops forming the baselayer, with all subsequent filament cable layers being wound in the customary manner. Flanges 18 and 19 can be used to define the pack length.

Although a wound wire baselayer is effective in guiding the laying down of the first filament layer, it is relatively expensive to fabricate.

Figure 2:
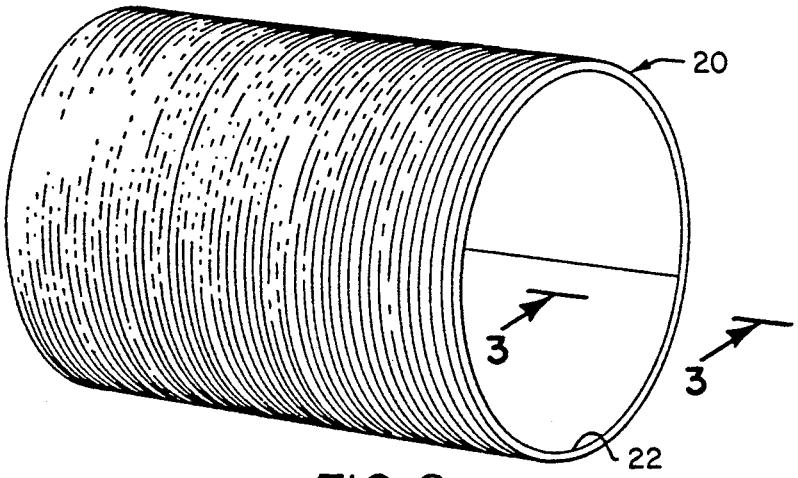
FIG. 2 is a perspective view of a baselayer constructed in accordance with one embodiment of the present invention.
Figure 3:
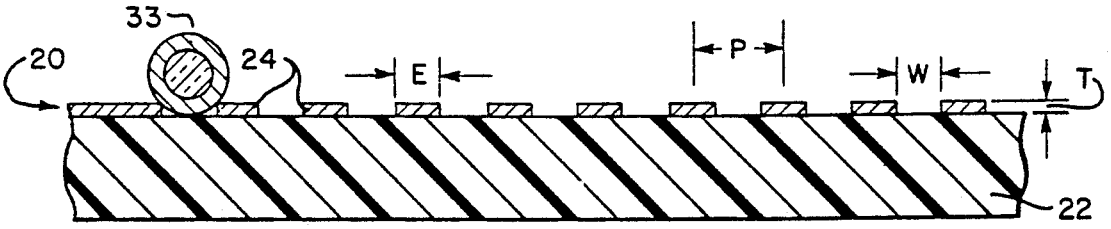
FIG. 3 is an enlarged, partially fragmentary sectional view of the baselayer of this invention taken along the line 3—3 of FIG. 2.

Reference is now made to FIGS. 2 and 3 for the ensuing description of a baselayer constructed in accordance with the present invention and which is enumerated generally as 20. This baselayer is substituted in place of the wire layer 16 of the prior art construction of FIG. 1, and it is onto this baselayer that a filament cable pack is wound. The baselayer 20 includes a rectangular sheetlike substrate 22 (or fan-shaped for a tapered bobbin) constructed of a synthetic plastic or composite material, such as that used in making circuit boards. More particularly, the substrate should be flexible enough so as to permit forming into a hollow cylinder as shown in FIG. 2 about the mandrel in a way that will be discussed later, and is, at the present time, best made from a flexible material, such as used to make a circuit board. The substrate 22 is so dimensioned as to fit into the external space of the mandrel which was occupied by the wire baselayer in the described prior art (FIG. 1), for example. The outer major surface of the baselayer is provided with a set of substantially rectangular cross-section cable guides 24 spaced apart in an equal manner and arranged to extend parallel to one another. The width E of each cable guide is of a predetermined specific amount dependent upon the diameter of the fiber and winding geometry that the baselayer is to accommodate. Similarly, the spacing P between adjacent cable guides is constant throughout the baselayer and unique for a particularly sized cable and winding geometry (e.g., precision or deep-nested).

Figure 4:
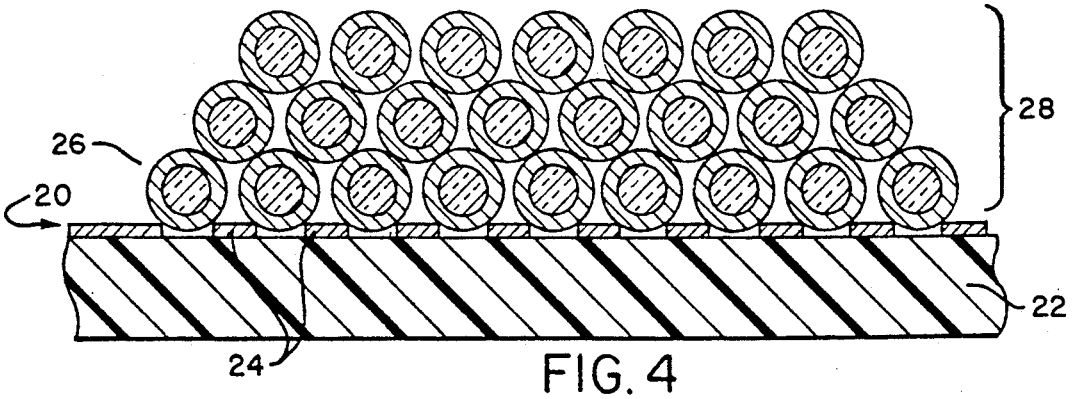
FIG. 4 is an end elevational, sectional view showing a cable pack wound onto the baselayer of FIG. 3.

In use of the baselayer of this invention, it is contemplated that a first cable layer 26 will be laid down into the spaces between the cable guides 24 as shown in FIG. 4. The dimensions and spacing of the guides have been selected so that the cable windings will be spaced apart from one another a constant amount as shown. Accordingly, each additional winding on the second and subsequent layers will be similarly spaced from its neighbor, and so on throughout the entire pack 28. This type of pack, as has already been noted, is stable and compact. Moreover, the described baselayer can be readily adapted for use in winding a pack on either a bobbin having end flanges or one not relying on flange securement for the pack.

Although the filament cable winding plane formed on the baselayer of FIGS. 2 and 3 is designed to be closely normal to the winding axis, this does not continue throughout a full 360 degree of all the windings. In order to move from a lower winding layer to the next upper layer, it is necessary that the guides 24 in the baselayer have a discrete pitch advancement for adjacent windings of the first layer.

The cable guides 24 of the baselayer 20 can be advantageously constructed by forming a thin plate of material on the substrate and etching the spaces, W, between the guides. Alternatively, the guides may be formed by plating of the guides onto the substrate. Both etching and plating are well known in the printed circuit art and presentation of details is, accordingly, considered beyond the scope of matters discussed here.

The described baselayer 20 is more stable than the known wire baselayer since the wire turns are occasionally displaced by the cable winding load resulting in disruption of pack geometry. Also, the invention is less critical in use than a wire baselayer because there is no wire-to-wire tolerance buildup as in the latter, which also, results in a smaller inventory of baselayer materials required for the invention. Still further, the baselayer of the invention is easily and quickly mounted onto a bobbin or mandrel, as opposed to application of a wire baselayer which is time consuming and during which time the winding machine used for laying down the wire layer cannot be productively used to wind cable.

A variety of materials may be found satisfactory for making guides 24 such as synthetic plastics, composites and metal. An etched metal plate (e.g., copper) formed by utilizing printed circuit techniques has been found to provide an excellent base layer in a practical construction of the invention.

Figure 7:
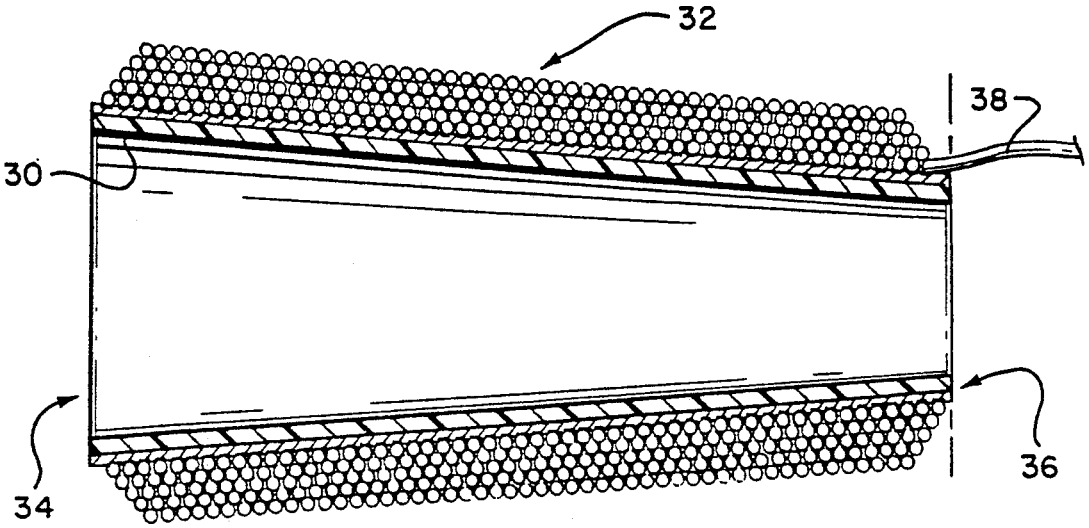
FIG. 7 is a side elevational, sectional view of a tapered bobbin with a filament pack wound thereon.

FIG. 7 depicts a tapered bobbin 30 with a correspondingly tapered filament pack 32 wound on the bobbin periphery which is a commonly employed configuration for many dispensers. Specifically, the tapered bobbin and pack typically have a circular cross-section that varies in diameter from a large end 34 to a small end 36. In use, the filament cable 38 is taken off or dispensed from the small end.

Figure 8:
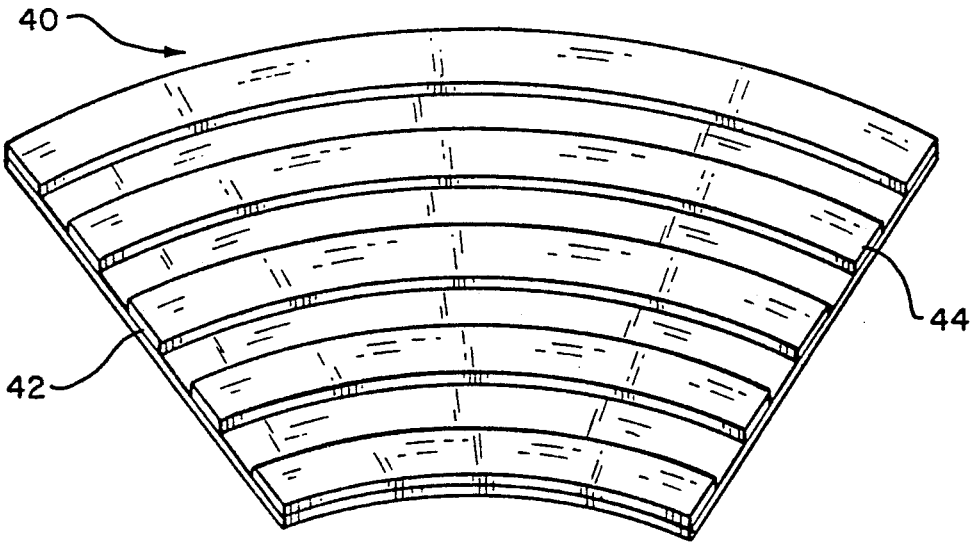
FIG. 8 is a top plan view of a baselayer of this invention for use on a tapered bobbin as shown in FIG. 7.

A baselayer 40 constructed in accordance with the first described embodiment for being used with a tapered bobbin is depicted in FIG. 8. As shown, when the baselayer is laid out flat it has a generally fan shape with each guide extending along a curved path so that when the two straight line edges 42 and 44 are joined the baselayer forms the necessary tapered geometry.

Figure 5:
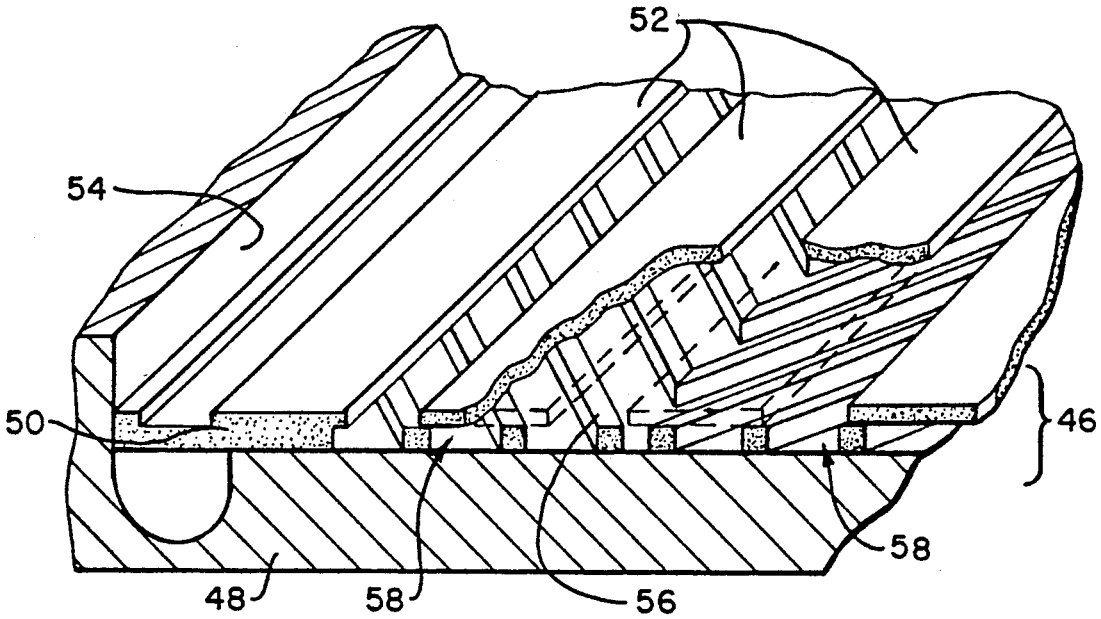
FIG. 5 is an elevational, sectional, partially fragmentary view of another embodiment of the invention.
Figure 6:
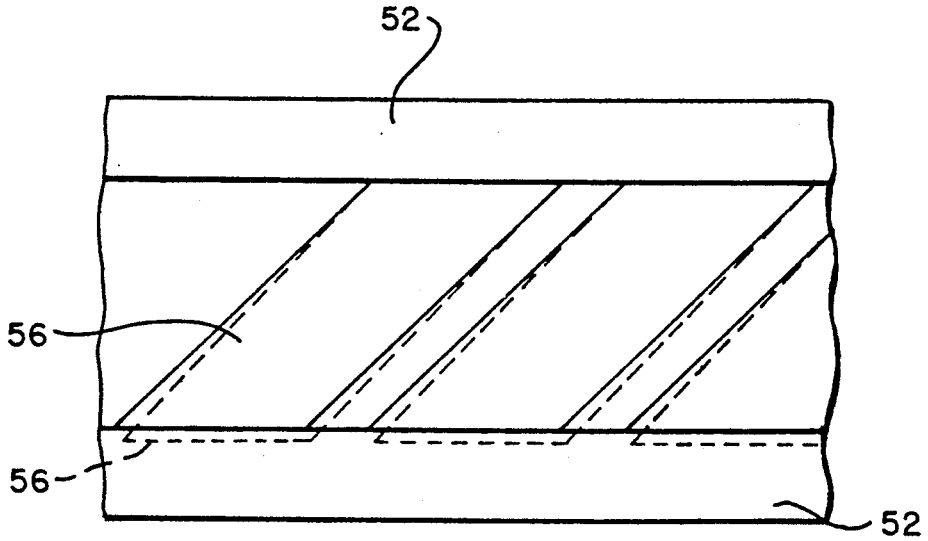
FIG. 6 is a top plan, schematic view of the alternate embodiment of FIG. 5 showing flexing during use.

For an alternate embodiment of the invention reference is made simultaneously to FIGS. 5 and 6. As shown there a baselayer 46 is seen to generally include a metal plate having its two opposite major surfaces etched in a manner so as to provide an outer surface with a plurality of parallel, spaced fiber guides and a lower surface configured to form a set of spring elements which acts to effect automatic and exact registration of the baselayer sides when it is forced between a pair of flanges on a bobbin or mandrel 48.

Specifically referring to FIG. 5, a thin metal plate 50 of overall rectangular geometry has what will be its outer surface in use etched to provide a plurality of cable guides 52 which can be identical in relative spacing and height to guide 24 of the first described embodiment. The guides extend precisely parallel to the baselayer lateral edges which abut against the mandrel flanges 54 (only one shown) when assembled for winding.

The opposite or lower surface of the plate 50 is etched to provide a plurality of spaced apart struts 56 arranged in a general herringbone configuration. More particularly, the struts in each herringbone segment 58 are parallel to one another and preferably each segment will have a width sufficient to underlie several guides 52 with the strut angular directions differing substantially for adjacent segments. The effect of the herringbone strut construction is to provide springlike resiliency in the baselayer plane which enables the baselayer lateral edges to precisely register with the faces of flanges 54 when the baselayer is mounted onto a winding mandrel. This latter feature will reduce manufacturing tolerance requirements which, in turn, will reduce overall cost while increasing product reliability.

The compliant baselayer 46 also permits use of a simpler and less expensive mandrel not requiring adjustable flanges. Furthermore, the openings between the guides 52 and struts 56 allow adhesive frequently used to stack stability to pass out of the pack through the baselayer to a sump and not remain in the pack in excessive amounts.

Mounting of either version of the invention can be accomplished in the same manner. The baselayer is wrapped around the winding mandrel with the baselayer lateral edges registered against the flange, by adjustment of the flanges, as a result of the baselayer resiliency, or both. An adhesive may be applied to the baselayer lower surface to aid in securement to the mandrel.

The term "cable" as used herein refers to any filament such as a metal wire, or an optical fiber, for example. The cables depicted in the drawings are optical fibers consisting of a quartz core surrounded by a compliant synthetic plastic; however, the invention can be equally advantageously employed with any other form of filament.

Although the foregoing has been a description and illustration of specific embodiments of the invention, various modifications and changes thereto can be made by persons skilled in the art without departing from the scope and spirit of the invention as defined by the following claims.

What is claimed is:

1. A winding form on which a filament pack is wound for properly positioning the individual turns in the innermost layer of said pack, comprising:

a mandrel having a smooth outwardly directed peripheral surface;

a flexible sheetlike support means having flat smooth opposite major surfaces one of which is disposed in intimate contacting relation with the mandrel smooth outwardly directed peripheral surface;

a plurality of parallel spaced apart guides on an outwardly direct major surface of said support means defining spaces therebetween for receiving a first layer of the filament wound within said spaces.

2. A winding form as in claim 1, in which the support means is a flexible sheet, and each of said guide is a plated strip secured to said flexible sheet.

3. A winding form as in claim 1, in which the support means is a flexible epoxy sheet; and said guide are constructed of a metal plate secured to a major surface of the epoxy sheet and having metal portions etched away from the plate to define the spaces between adjacent guides.

4. A winding form as in claim 1, in which there are further provided first and second flanges mounted in spaced apart relation on the mandrel having respective parallel faces between which the pack is wound, said flange faces being substantially parallel to said guides; the support means having two opposite end edges which respectively abut the first and second flanges to align the guides to form a plurality of continuous guide rings separated by intervening spaces within which spaces the filament is received.

5. A winding form as in claim 1, in which the support means further includes a platelike member having a lower surface configured into a plurality of spaced apart struts providing resiliency in the plane of the platelike member.

6. A winding form as in claim 5, in which the guides are etched onto a surface of the platelike member opposite to the lower surface.

7. A winding form as in claim 5, in which the struts are arranged in segments, each segment including a plurality of struts parallel to one another within the same segment, and the struts of adjacent segments are directed at substantially different angles to provide a herringbone arrangement.

8. A winding form as in claim 1, in which the guides are constructed of a synthetic plastic.

9. A winding form as in claim 1, in which the guides are constructed of a composite material.

10. A winding form as in claim 5, in which the support means and guides are constructed of metal.

11. A winding form as in claim 5, in which the support means and guides are constructed of a synthetic plastic.

12. A winding form as in claim 5, in which the support means and guides are constructed of a composite material.

13. A winding form as in claim 1, in which the winding mandrel has a uniform cross-section; and the sheetlike support means is rectangular for folding receipt about the mandrel with two opposite edges abutting against one another and guide ends along said edges aligning with one another.

14. A winding form as in claim 1, in which the winding mandrel is tapered with a small end and a large end; and the support means if of such geometry and dimensions as to wrap around the mandrel with two opposite edges of the support means abutting against one another.

* * * * *

UNITED STATES PATENT AND TRADEMARK OFFICE

CERTIFICATE OF CORRECTION

PATENT NO. : 5,067,665

DATED : November 26, 1991

INVENTOR(S) : Gregory LoStracco; George W. LeCompte

It is certified that error appears in the above-identified patent and that said Letters Patent is hereby corrected as shown below:

Column 6, line 4, replace "direct" with the word --directed--.

Column 6, line 11, replace "guide" with the word --guides--.

Signed and Sealed this

Fourth Day of May, 1993

*Attest:*

Michael K. Kirk

MICHAEL K. KIRK

*Attesting Officer*

*Acting Commissioner of Patents and Trademarks*